United States Patent [19]

Sugiura

[11] Patent Number: 4,715,196

[45] Date of Patent: Dec. 29, 1987

[54] OIL RETURNING MECHANISM OF EVAPORATOR FOR AIR CONDITIONER

[75] Inventor: Hiroyuki Sugiura, Saitama, Japan

[73] Assignee: Diesel Kiki Co., Ltd., Tokyo, Japan

[21] Appl. No.: 33,818

[22] Filed: Apr. 3, 1987

[30] Foreign Application Priority Data

Apr. 11, 1986 [JP] Japan ..... 61-82164
May 23, 1986 [JP] Japan ..... 61-118824

[51] Int. Cl.[4] ..... F25B 43/02

[52] U.S. Cl. ..... 62/468; 62/84; 62/471

[58] Field of Search ..... 62/468, 84, 469, 470, 62/471

[56] References Cited

FOREIGN PATENT DOCUMENTS 47-7168 3/1972 Japan .
55-165452 12/1980 Japan .

*Primary Examiner*—Henry A. Bennet
*Attorney, Agent, or Firm*—Wenderoth, Lind & Ponack

[57] ABSTRACT

An air conditioner including a cooling medium compressor, a condenser, an expansion valve and an evaporator, these being connected one another by a cooling medium capillary tube to circulate a cooling medium, whereby an oil returning mechanism of an evaporator for the air conditioner is characterized in that there is provided an oil reservoir for reserving a lubricating oil after oil separation at a lower part of the evaporator, the oil reservoir and an outlet tube for guiding the cooling medium passed through the evaporator to the cooling medium compressor being connected by an oil returning tube, the oil returning tube being provided with a controlling valve, when a pressure differential between the oil returning tube and the outlet tube is a predetermined level or more, the controlling valve being closed to enhance a normal flow of the cooling medium from the evaporator to the cooling medium compressor, when the pressure differential is a predetermined level or less, the lubricating oil staying in the oil reservoir being fed to the cooling medium compressor via the oil returning tube and outlet tube.

3 Claims, 12 Drawing Figures

OIL RETURNING MECHANISM OF EVAPORATOR FOR AIR CONDITIONER

BACKGROUND OF THE INVENTION

1. Field of the Invention

This invention relates to an oil returning mechanism of an evaporator for an air conditioner equipped with, for example, a variable capacity type cooling medium compressor.

2. Description of the Prior Art

In general, the lubrication of a cooling medium compressor for an air conditioner is performed by utilizing a lubricating oil in a cooling medium. This lubricating oil is flowed into a condenser and an air conditioner from a cooling medium compressor together with a cooling medium during the operation of the air conditioner and the lubricating oil within the compressor is reduced. Therefore, the oil flowed into the condenser and evaporator is somehow required to be returned to the compressor.

The prior art intended to meet with such requirements is disclosed, for example, in Japanese Utility Model Early Laid-open Publication No. 47-7168 and Japanese Patent Early Laid-open Publication No. 55-165452. Of these Publications, the former discloses an oil returning mechanism in which a cooling medium tube between a cooling medium compressor and a condenser is cut apart, a baffle plate is interposed between opposite communication ports, a capillary tube connected to a bottom portion of a main body is connected to the cooling medium tube between the cooling medium compressor and evaporator in order to feed the lubricating oil separated from the medium into the cooling medium compressor. On the other hand, the latter discloses an oil separator interposed between a cooling medium compressor and a condenser, in which a multistage throttle is provided to a bottom portion of its main body, and the throttle is communicated with the cooling medium compressor through a passage, so that the quantity of the lubricating oil separated therein for returning to the compressor can be adjusted through the throttle.

However, these conventional apparatuses have such problems as that since oil is separated using a pressure energy of a cooling medium and such separated lubricating oil is collected, these apparatuses are practically applicable only to a cooling circuit in which a cooling medium is high pressure and cannot be employed for a low pressure circuit such as, for example, vicinity of an evaporator where the oil separating and oil returning functions are lowered. Particularly, these problems are serious for an air conditioner equipped with a variable capacity type cooling medium compressor which has been expected to be widely prevailed in recent years, because the oil returning quantity to the cooling medium compressor is extremely reduced during its very small load operation and the lubrication is worried.

The present invention was accomplished in order to solve these problems.

SUMMARY OF THE INVENTION

It is therefore an object of the present invention to provide an oil returning mechanism of an evaporator for an air conditioner, wherein, in an evaporator disposed at a low pressure side of a cooling cycle, the oil return of a lubricating oil stayed within the evaporator is enhanced when a cooling load is small to prevent the reduction of the lubricating oil within the cooling medium compressor, and a normal oil return is recovered when a cooling load is large to obtain a favorable lubrication of the cooling medium compressor.

A specific object of the present invention is to provide an oil returning mechanism of an evaporator for an air conditioner, wherein a minimum quantity of lubricating oil is fed to a cooling medium compressor even when the air conditioner is operated under a very small load, so that the burning of the cooling medium compressor can be prevented.

Another important object of the present invention is to provide an oil returning mechanism of an evaporator for an air conditioner, wherein the air conditioner is operatable under a very small load so that the oil returning mechanism is suitable for an air conditioner equipped with a variable capacity type cooling medium compressor.

In order to achieve the above objects, there is essentially provided an air conditioner including a cooling medium compressor, a condenser, an expansion valve and an evaporator, these being connected one another by a cooling medium capillary tube to circulate a cooling medium, whereby an oil returning mechanism of an evaporator for the air conditioner is characterized in that there is provided an oil reservoir for reserving a lubricating oil after oil separation at a lower part of said evaporator, said oil reservoir and an outlet tube for guiding the cooling medium passed through said evaporator to said cooling medium compressor being connected by an oil returning tube, said oil returning tube being provided with a controlling valve, when a pressure differential between said oil returning tube and said outlet tube is a predetermined level or more, said controlling valve being closed to enhance a normal flow of the cooling medium from said evaporator to said cooling medium compressor, when said pressure differential is a predetermined level or less, the lubricating oil staying in the oil reservoir being fed to said cooling medium compressor via said oil returning tube and outlet tube.

BRIEF DESCRIPTION OF THE DRAWINGS

FIGS. 4 through 6 are illustrations of a second embodiment of the present invention, wherein;

FIG. 4 is a schematic view thereof;

FIG. 5 is an enlarged sectional view of one example of a controlling valve and a throttle valve which are employed in the second embodiment in which the controlling valve is now in its opened state;

FIG. 6 is a sectional view of the controlling valve now in its closed state;

DETAILED DESCRIPTION OF THE PREFERRED EMBODIMENTS

Figure 1:
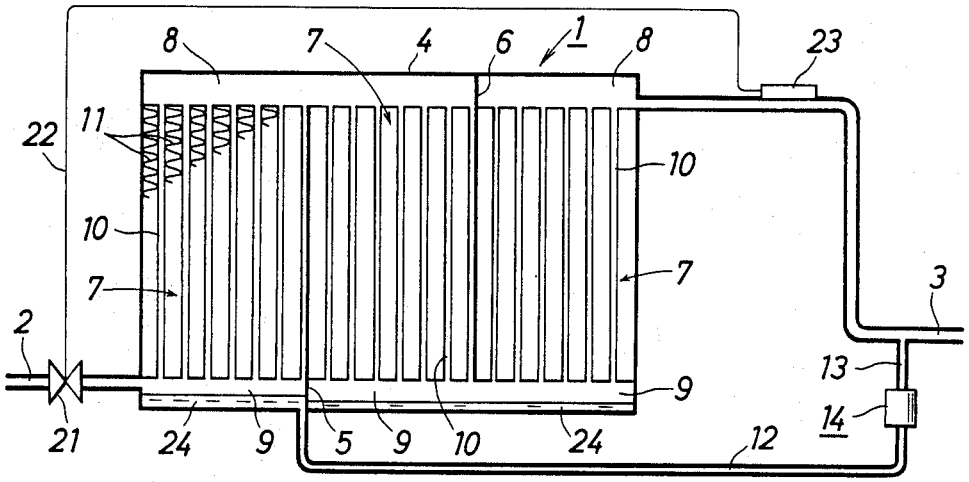
FIG. 1 is a schematic view showing one embodiment of the present invention.
Figure 2:
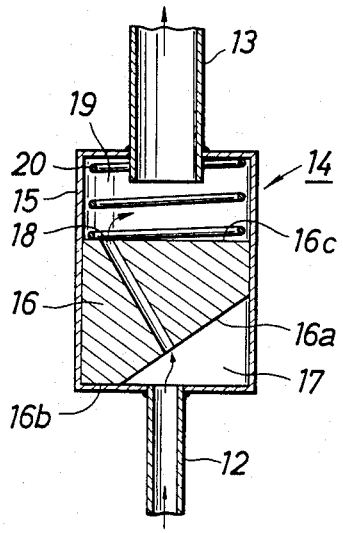
FIG. 2 is an enlarged sectional view showing one example of a controlling valve now in its opened-state, which is employed in the present invention.
Figure 3:
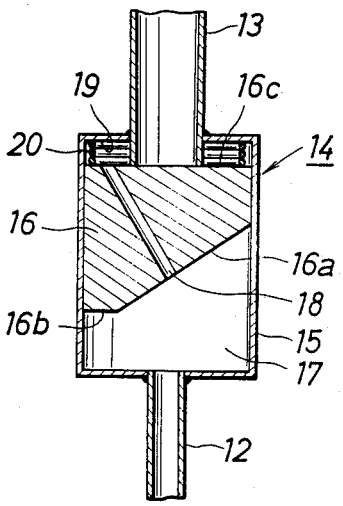
FIG. 3 is a sectional view of the controlling valve now in its closed state.

One preferred embodiment of the present invention will be described hereunder with reference to the accompanying drawings, in which the present invention is applied to a lamination type evaporator. In FIGS. 1 through 3, 1 generally denotes a lamination type evaporator interposed between a cooling medium capillary tube communicated with a receiver tank T and an outlet tube 3 communicated with a cooling medium compressor Cp, in which a plurality of partition chambers 7 are defined within a horizontal framework 4 through partition plates 5 and 6.

The partition chambers 7 are provided at the upper and lower end portions with a communicating path 8 comprising an upper tank and a lower tank forming an oil reservoir 9. Between this communicating path 8 and the oil reservoir 9, a plurality of cooling medium passages 10 comprising a cooling medium tube communicating with the communicating path 8 and oil reservoir 9 are vertically arranged. Between adjacent cooling medium passages 10, a corrugated radiating tube 11 is disposed.

Of the above-mentioned partition chambers 7, the oil reservoir 9 of the partition chamber 6 at a lower part of an inlet port side of a cooling medium is connected with one end of an oil returning tube 12. The other end of the oil returning tube 12 is communicated with the outlet tube 3 through a connecting tube 13. Between the oil returning tube 12 and connecting tube 13, a controlling valve 14 is disposed.

The controlling valve 14 includes a hollow valve housing 15 as shown in FIGS. 2 and 3. The housing 15 is provided at its upper part with one end of the connecting tube 13 projecting inwardly therefrom and contains at its lower part a valve main body 16 which is vertically slidable. The valve main body 16 is formed of, for example, a generally angle-cut cylindrical light weight metallic member. The valve main body 16 is formed at its lower end face with a flat sitting-face 16*b* continuing to an angle-cut face 16*a*. The sitting-face 16*b* is sittable on the inner surface at a bottom portion of the valve housing 15. When the sitting-face 16*b* sits, an opening end of the oil returning tube 12 is opened. In addition, the sitting-face 16*b* cooperates with the angle-cut face 16*a* to form a preliminary pressure chamber 17 communicated with the oil returning tube 12.

An upper end face 16*c* of the valve main body 16 has the same configuration as the hollow cross section of the valve housing 15. At an outer end face of the valve main body 16, a communicating hole 18 piercing through the inside of the valve main body 16 at angles is opened up. The preliminary pressure chamber 17 is communicated with a valve chest 19 formed at an upper part within the valve housing 15 through the communicating hole 18. The position where the communicating hole 18 is opened up at the upper end face 16*c* is spaced apart from the opening end of the connecting tube 13. When the upper end face 16*c* is abutted with the projecting end of the connecting tube 13, the opening end of the connecting tube 13 is blocked.

A spring 20 is interposed between the inner surface at the upper part of the valve housing 15 and the upper end face 16*c*. Due to the restoring force of the spring 20, the valve main body 16 is normally energized downwardly, thereby to cause the sitting face 16*b* to sit on the bottom of the valve housing 15 as shown in FIG. 2. In the figure, 21 denotes an inter-equalizing type expansion valve provided to the cooling medium capillary tube 2 with a pressure bulb (heat sensitive cylinder) 23 on the front end of the capillary tube 22 intimately attached to the outer surface of the outlet tube 3. 24 denotes a lubricating oil after oil separation contained within the respective oil reservoirs 9.

The function of the oil returning mechanism will be described next.

When the air conditioner is operated and the cooling medium discharged from the cooling medium compressor Cp reaches the expansion valve 21 guided by the cooling medium capillary tube 2, the feeding quantity of the cooling medium is adjusted according to the operating state of the air conditioner, i.e., cooling load at the valve 21 and such adjusted cooling medium is fed to the evaporator 1.

More specifically, when the cooling load is small, the expansion valve 21 regulates the feeding quantity of the cooling medium so that only a small quantity is fed to the evaporator 1. On the other hand, when the cooling load is large, the expansion valve 21 regulates the feeding quantity of the cooling medium so that an increased quantity is fed to the evaporator 1. Therefore, the cooling medium pressure loss within the evaporator 1 is varied according to the throttling effect of the expansion valve 21. That is, when the cooling load is small, it also becomes small but when the cooling load is large, it also becomes comparatively large.

In this way, the cooling medium moves in a zigzag direction through the cooling medium passages 10 arranged within the respective partition chambers 7 within the evaporator 1 and is discharged from the outlet tube 3. In the meantime, the cooling medium contacts or hits the internal walls of the cooling medium passages 10 and is crushed into fine particles. And, the oil content having a large specific weight is separated from the cooling medium gas and reserved in the oil reservoir 9 provided to the bottom portions of the respective partition chambers 7. In this embodiment, one end of the oil returning tube 12 is connected with the partition chamber 7 at the inlet port side where the oil is most easily pooled, so that the oil returning efficiency is enhanced.

In this way, the cooling medium is evaporated while moving through the respective partition chambers 7 and, as described in the foregoing, discharged through the output tube 3 with the pressure gradually dropped. The pressure loss at the time when it is discharged becomes small when the cooling load is small. However, it becomes comparatively large when the cooling load is large.

Accordingly, a pressure differential is produced between the pressure of the oil returning tube 12 communicated with the partition chamber 7 at the cooling medium inlet port side and the pressure of the connecting tube 13 communicated with the outlet tube 3. When, for example, the cooling load is small, the pressure differential becomes small according to the throttling effect due to the expansion valve 21.

As a result, when the cooling load is small, as shown in FIG. 2, the valve main body 16 is pushed down by the spring 20 resisting the pressure within the oil returning tube 12 and the sitting face 16c sits on the bottom of the valve housing 15, thereby to form a preliminary pressure chamber 17 communicated with the oil returning tube 12 at a lower end part within the housing 15. The preliminary pressure chamber 17 is communicated with the valve chest 19 through a communicating hole 18. The valve chest 19 is communicated with the outlet tube 3 through the connecting tube 13. In this way, the outlet tube 3 is communicated with the oil returning tube 12.

Due to the foregoing arrangement, the lubricating oil 24 reserved in the oil reservoir 9 of the partition chamber 7 at the cooling medium inlet port side is pushed out into the oil returning tube 12 by the pressure within the chamber 7 and flowed into the preliminary pressure chamber 17 of the controlling valve 14.

As indicated by arrows of FIG. 2, the lubricating oil 24 flowed into the preliminary pressure chamber 17 is flowed into the valve chest 19 via the communicating hole 18 formed in the valve main body 16, then reaches the outlet tube 3 from the chest 19 guided by the connecting tube 13, then joints a cooling medium gas flowing within the tube 3, then moves toward the cooling medium compressor Cp and finally returned to the compressor Cp.

That is, when the cooling load is small, the controlling valve 14 is opened by utilizing the pressure differential between the partition chamber 7 and the outlet tube 3 and, due to the pressure differential, the lubricating oil 24 pooled within the partition chamber 7 is sucked out into the oil returning tube 12 and introduced into the outlet tube 3 to be returned to the cooling medium compressor Cp. Therefore, the reduction of lubricating oil which is likely to occur within the tube 3 at this time can be prevented. Thus, a favorable lubrication of the compressor Cp can be obtained. In addition, the cooling efficiency of the evaporator 1 can be enhanced to the extent of the removal of the lubricating oil 24.

In this case, since a part of the cooling medium is mixed with the lubricating oil 24 in the oil returning tube 12 and introduced into the outlet tube 3, the cooling performance of the evaporator 1 is decreased to that extent. However, this does not affect adversely to the operation of the air conditioner in actual practice because the leaking quantity of the cooling medium is very small and besides the maximum performance is not required for the operation of the air conditioner at this time.

Next, under the operation of the air conditioner, when the feeding quantity of the cooling medium is increased to the evaporator 1 upon actuation of, for example, the expansion valve 21, or when the pressure of the outlet tube 3 communicated with the suction port is dropped due to acceleration of the rotating speed of the cooling medium compressor Cp, the pressure differential formed between the oil returning tube 12 and the connecting tube 13 becomes large.

When such cooling load is increased, the valve main body 16 is moved upwardly under pressure of the oil returning tube 12 while urgedly pushing the spring 20 and stopped at a position where the upper end face 16c is abutted against the opening end of the connecting tube 13. At this time, as shown in FIG. 3, the opening portion of the connecting tube 13 is blocked with the valve main body 16 and the controlling valve 14 is closed.

Due to the foregoing, the cooling medium is prevented from flowing into the outlet tube 3 from the controlling valve 14. As a result, the normal flow of the cooling medium is recovered within the outlet tube 3. The lubricating oil is moved together with the cooling medium and returned to the cooling medium compressor Cp. Accordingly, the normal lubrication is performed within the cooling medium compressor Cp and the evaporator 1 shows its maximum performance for cooling operation. More specifically, when the cooling load is small, by utilizing the pressure differential between the partition chamber 7 and the outlet tube 3, the controlling valve 14 is closed to cut the oil passage from the oil returning tube 12 to the outlet tube 3, so that only one cooling medium passage is formed by the outlet tube 3. The normal oil return to the cooling medium compressor Cp is recovered through this cooling medium passage.

Figure 4:
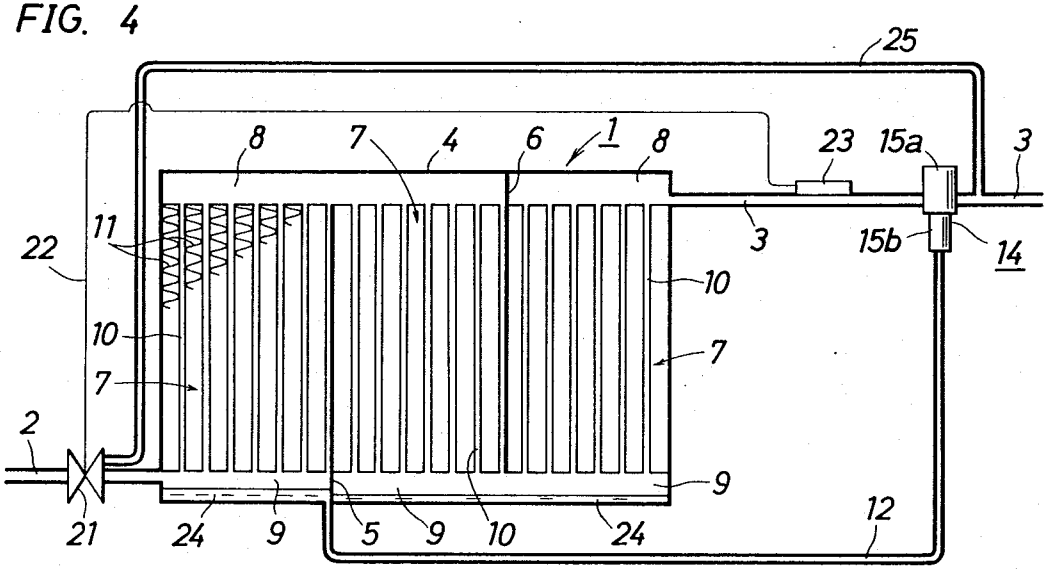
Figure 6:
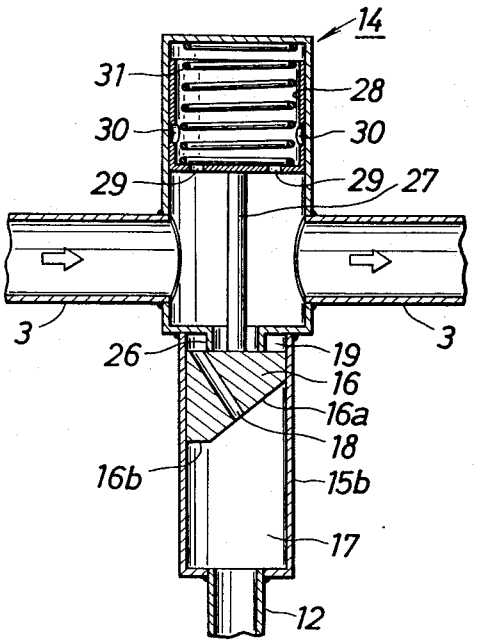
Figure 5:
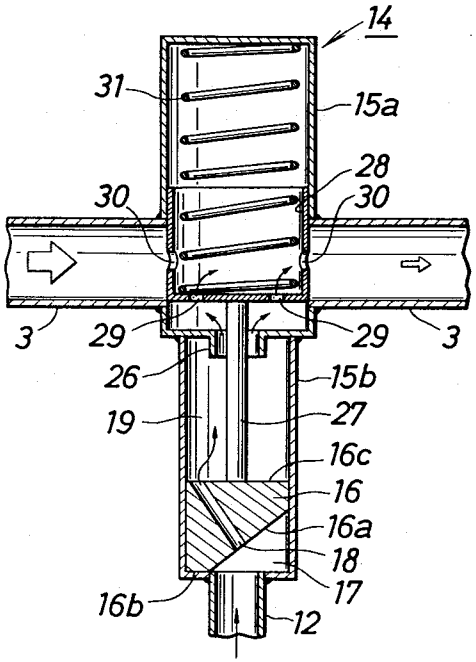
Figure 7:
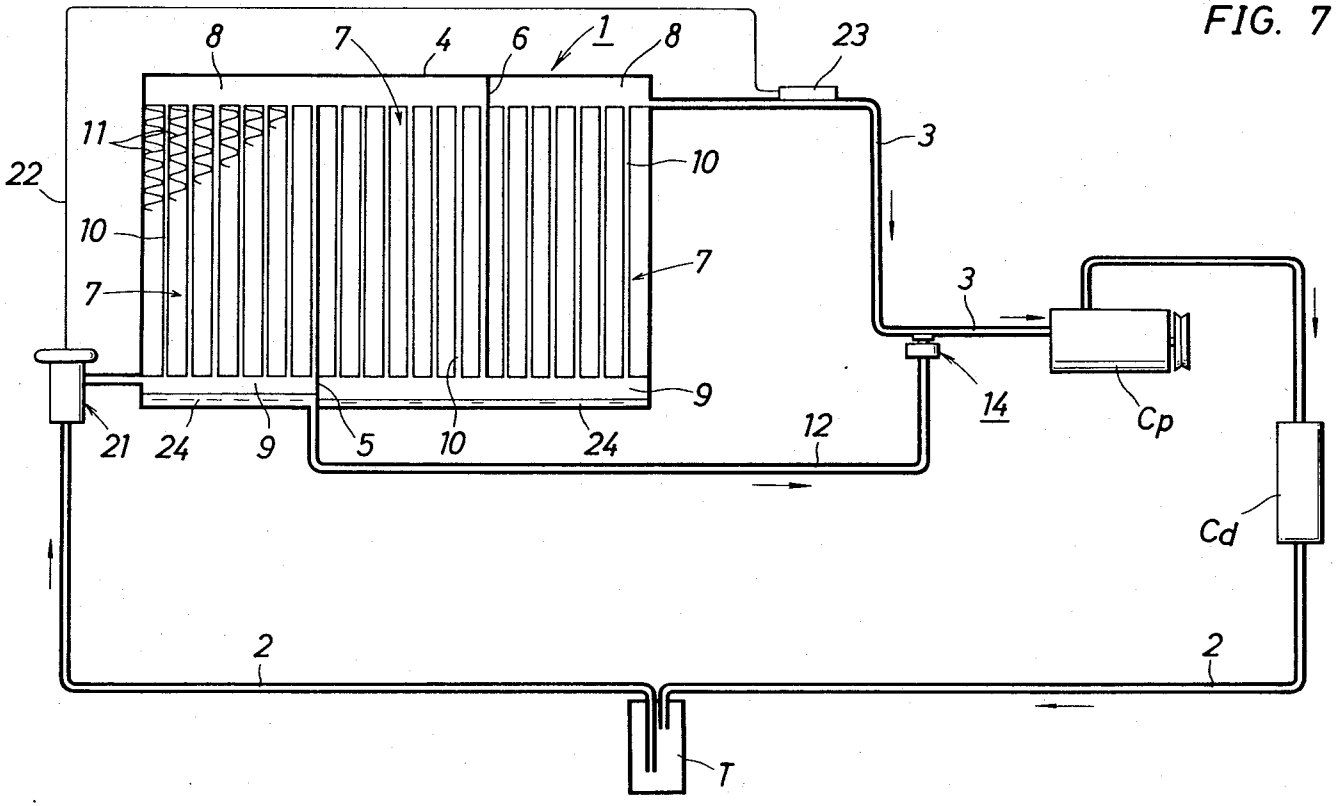
FIG. 7 is a schematic view showing a third embodiment of the present invention.

Referring now to FIGS. 4 through 10, other embodiments of the present invention will be described, wherein the corresponding component parts to those of the preceding embodiment are denoted by identical reference numerals. Of these figures, FIGS. 4 through 6 illustrate a second embodiment of the present invention in which the inter-equalizing expansion valve 21 used in the preceding embodiment is taken place with an outer-equalizing type expansion valve 2. There is provided a controlling valve 14 at the upper stream side, i.e., a position nearer to the evaporator 1, of the connecting position of its outer-equalizing tube 25 and outlet tube 3.

The controlling valve 14 includes a tubular upper valve housing 15a intersecting the outlet tube 3 and connected therewith, and a lower valve housing 15b integrally connected with a lower end of the housing 15a. An upper part of the upper valve housing 15a is blocked, while a lower end thereof is provided with a mouthpiece 26 of a small diameter corresponding to the projecting end of the connecting tube 13. The upper end of the lower valve housing 15b is fixed to the outer side of the metal piece 26. In this way, the upper and lower valve housings 15a and 15b are tightly sealed.

Within the lower valve housing 15b, a valve main body 16 similar to the one already described is vertically slidably contained. An upper end face 16c of the valve main body 16 is able to abut with the mouthpiece 26. A lower end of a connecting rod 27 is secured to the upper end face 16c. An upper end of the connecting rod 27 27 is connected with a throttle valve 28. The valve 28 comprises a cylindrical tube member having a bottom but no top. The cross section of the valve 28 is same as the hollow cross section of the upper valve housing 15b. The throttle valve 28 is also vertically slidably contained in the housing 15b for sliding integrally with the valve main body 16.

The throttle valve 28 is formed at its bottom with a plurality of through holes 29. The throttle valve 28 is also provided with a pair of orifices 30, 30 opposite with respect to each other at corresponding places along the axial direction of the outlet tube 3 on its side periphery. The upper valve housing 15a, the valve chest 19 of the lower valve housing 15b and the outlet tubes 3, 3 are able to intercommunicate through the through holes 29 and orifices 30.

And, a spring 31 is interposed between the bottom of the throttle valve 28 and the blocked end of the upper valve housing 15*a*. The valve main body 16 and the throttle valve 28 are normally energized downwardly through the restoring force of the spring 31. As a result, the sitting face 16*b* of the valve main body 16 is urged to sit on the bottom of the lower valve housing 15*b* as shown in FIG. 5.

In this second embodiment, when the cooling load of the air conditioner is small, in other words, when the feeding quantity of the cooling medium is reduced by the expansion valve 21, the pressure loss of the cooling medium passing through the evaporator 1 becomes small and the pressure differential between the pressure of the oil returning tube 12 and the pressure of the outlet tube 3 formed at its tube end portion becomes small, the valve main body 16 and the throttle valve 28 are moved downwardly by the spring 31 resisting the pressure within the oil returning tube 12. As a result, as shown in FIG. 5, the valve main body 16 is urged to sit on the bottom of the lower housing 15*b* and the throttle valve 28 is positioned within the passage of the outlet tube 3.

Accordingly, in this case, the preliminary pressure chamber 17 is communicated with the valve chest 19 through the passage hole 18 formed at the valve main body 16. The chest 19 is communicated with the outlet tube 3 through the opening portion of the mouthpiece 26, the through holes 29 and orifices 30 formed on the throttle valve 28. In this way, the oil returning tube 12 is communicated with the outlet tube 3.

According to the afore-mentioned movement of the throttle valve 28, the cooling medium flowing within the outlet tube 3 is moved toward the downstream side through the orifices 30, 30. However, the flow rate thereof is restricted and small. In addition, the pressure within the throttle valve 29 and the pressure within the tube 3 at the downstream side of the valve 28 are dropped according to the orifice effect owing to the orifices 30, 30. As a result, the pressure differential between the internal pressure of the tube 3 at the upper stream side and the internal pressure thereof at the downstream side with the throttle valve 28 therebetween is increased.

Because of the foregoing, the pressure differential between the pressure within the throttle valve 28 through the outlet tube 3 at the downstream side thereof and the pressure within the valve chest 19 through the oil returning tube 12 is increased. As a result, the lubricating oil 24 after oil separation stayed in the oil reservoir 9 of the partition chamber 7 at the cooling medium inlet port side is sucked out into the oil returning tube 12 and flowed into the preliminary pressure chamber 17 as indicated by arrows of FIG. 5. And, this lubricating oil 24 is introduced into the throttle valve 28 from the passage hole 18 of the valve main body 16 via the valve chest 19 and the opening portion of the mouthpiece 26 and flowed into the outlet tube 3 at the downstream side of the orifices 30.

That is, in this case, due to the orifice effect of the orifices provided to the throttle valve 28, the pressure within the throttle valve 28 and the pressure within the outlet tube 3 at the downstream side of the valve 28 are dropped, thereby to increase the pressure differential with respect to the pressure of the oil returning tube 12 to that extent. As a result, the introduction of the lubricating oil 24 into the outlet tube 3 is enhanced. At the same time, the oil returning efficiency to the cooling medium compressor Cp is facilitated.

On the other hand, when the cooling load of the air conditioner becomes large and the cooling medium feeding quantity by the expansion valve 21 is increased, or when the flowing quantity of the cooling medium is increased due to the increased rotation of the cooling medium compressor Cp, the pressure loss of the cooling medium passing through the evaporator 1. When the pressure differential between the oil returning tube 12 and the outlet tube 3 reaches a predetermined level or more, the valve main body 16 and throttle valve 28 are integrally moved upwardly under the pressure of the oil returning tube 12 resisting the spring 31. The upward movement of the valve main body 16 and throttle valve 28 is stopped when the upper end face 16*c* of the valve main body 16 is abutted against the opening edge of the mouthpiece 26.

Accordingly, in this case, since the opening portion of the mouthpiece 26, as shown in FIG. 6, is blocked with the valve main body 16 and the oil passage from the valve chest 19 to the outlet tube 3 is cut, the lubricating oil 24 within the oil returning tube 12 does not flow out into the outlet tube 3. On the other hand, the throttle valve 28, as shown in the figure, is retreated from the passage of the outlet tube 3 and contained within the upper valve housing 15*a*. As a result, the normal passage of the cooling medium at the outlet tube 3 is recovered, and the lubricating oil is fed to the cooling medium compressor together with the cooling medium moving within the tube 3. That is, in this case, a normal cooling medium flow is occured within the outlet tube 3 and a normal oil return is taken place.

In a third embodiment shown in FIGS. 7 through 10, an expansion valve (21) provided at the inlet port side of the cooling medium of the evaporator (1) comprises a hollow cylindrical valve housing (32).

Figure 8A:
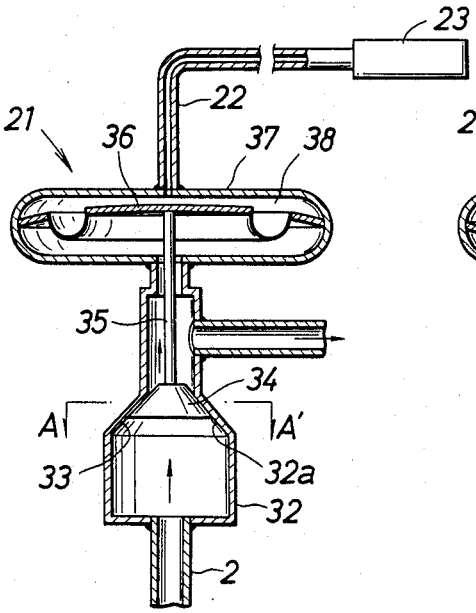
FIG. 8 is a sectional view showing an operating state of an expansion valve which is employed in the present invention, wherein FIG. 8(*a*) illustrates the expansion valve when an air conditioner is operated under a very small load, and FIG. 8(*b*) illustrates the expansion valve when the air conditioner is in its normal operation.
Figure 8B:
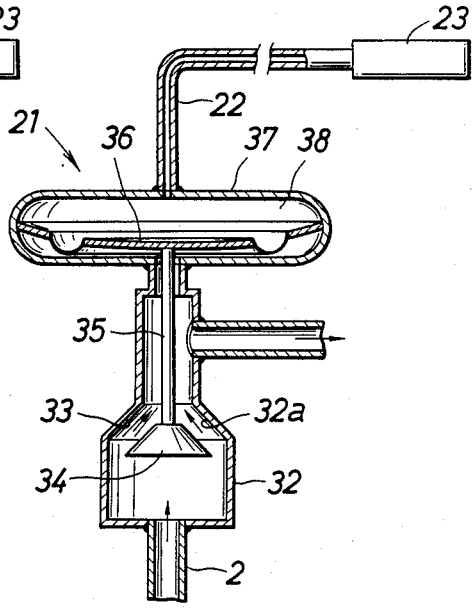
Figure 9:
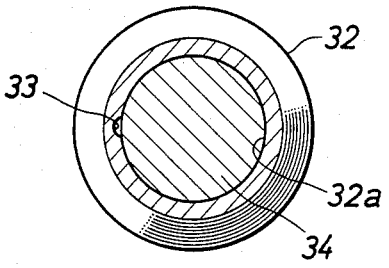
FIG. 9 is an enlarged sectional view taken on line A—A' of FIG. 8(*a*)

The valve housing (32), as shown in FIG. 8, has a tapered seat plane 32*a* which is gradually contracted in diameter as it goes upwardly at its central high portion. A groove-like passage 33, as shown in FIG. 9, is formed in the vertical direction of the seat plane 32*a*. Due to the foregoing arrangement, even when the valve 34 is closed, the inside of the housing 32 is able to communicate.

The valve 34, as shown in FIG. 8 is formed in a generally conical trapezoid which is able to engage with the seat plane 32*a*. One end of a valve stem 35 is fixed to an upper end portion of the valve 34 and the other end thereof is fixed to a diaphragm 36. The diaphragm 36 is pressure variably contained within a diaphragm case 37 fixed to an upper end of the valve housing 32, so that the valve 34 is vertically moved according to the variation thereof.

The diaphragm case 37 is connected with one end of a capillary tube 22 communicated with the diaphragm chamber 38, and the other end thereof is connected with a pressure bulb 23. A heat sensitive fluid is filled in the diaphragm chamber 38, capillary tube 22 and pressure bulb 23. In this case, there may be used an expansion valve of the type that, owing to the property of the heat sensitive fluid, the valve 34 is not closed and a minimum opening is maintained.

Figure 10B:
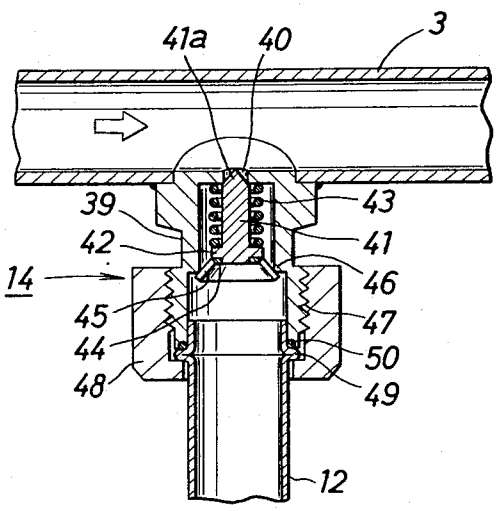
FIG. 10 is a sectional view showing an operating state of a controlling valve which is employed in the present invention, wherein FIG. 10(*a*) illustrates the controlling valve when an air conditioner is operated under a very small load, and FIG. 10(*b*) illustrates the controlling valve when an air conditioner is in its normal operation.
Figure 10A:
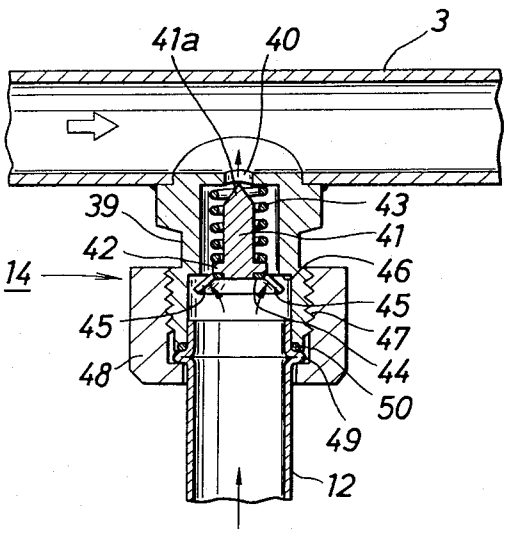

On the other hand, the controlling valve 14, as shown in FIG. 10, has a tubular valve main body 39 mounted on the outlet tube 3. The main body 39 is formed with an opening portion 40 at its end face adjacent to the outlet tube 3. A pressure responsive valve 41 is vertically movably contained within the main body 39.

The pressure responsive valve 41 comprises a light weight rod member including a conical seal face 41*a* at its upper end portion. The lower end portion of the pressure responsive valve 41 is formed with a flange portion 42. Between the flange portion 42 and the inner periphery of the opening portion 40, a spring 43 is interposed. The valve 41 is normally energized downwardly by the spring 43.

A generally dish-like stopper 44 is secured to right under the flange portion 43. A peripheral portion of the stopper 44, as shown in FIG. 10, is bent downwardly at angles and this slant portion is provided with a plurality of communicating passages 45 such as cutouts or through holes. The upward movement of the pressure responsive valve 41 is restricted when these opening edge portions are engaged with a step portion 46 formed within the main body 39.

47 denotes a male screw portion provided to the periphery of the lower end portion of the valve main body 39. The screw portion 47 is engaged with a nut 48. A flange portion 49 formed on the end portion of the oil returning tube 12 is retained by an internal opening edge portion of the nut 48. An O-ring 50 is inserted between the flange portion 49 and the lower end portion of the valve main body 39 so as to oil tightly connect the oil returning tube 12.

That is, in this third embodiment, when the cooling load of the air conditioner is lowered and the cooling medium flowing within the outlet tube 3 reaches a predetermined temperature or less, the heat sensitive fluid filled in the pressure bulb 23 adapted to detect this temperature is contracted, and the pressure within the diaphragm chamber 38 communicated with the capillary tube 22 is lowered. As a result, the diaphragm 36 is pushed upwardly. Due to the foregoing, the valve 34 connected with the valve stem 35 which is integrally displaced together with the diaphragm 36 is moved upwardly so as to restrict the feeding quantity of the cooling medium into the evaporator 1 by making a space formed between the seat face 32*a* and the valve 34.

Accordingly, when the cooling load of the air conditioner is small, the opening degree of the expansion valve 21 is throttled, so that the feeding quantity of the cooling medium is restricted and the flowing resistance or pressure loss is lowered within the evaporator 1. On the other hand, before or after this, the cooling medium compressor Cp is brought to be small in capacity due to internal pressure detection. Since the discharging quantity of the cooling medium is reduced, the pressure differential between the outlet tube 3 and the oil returning tube 12 becomes small.

As a consequence, the pressure responsive valve 41 contained within the controlling valve 14 is moved downwardly owing to the restoring force of the spring 43 to spread the space between the seal face 41*a* and the opening portion 40. Accordingly, the lubricating oil 24 sucked out from the oil reservoir 9 is flowed into the valve main body 39 guided by the oil returning tube 12 to joint the cooling medium within the outlet tube 3 from the opening portion 40 and fed into the cooling medium compressor Cp.

In this way, the cooling load of the air conditioner is further decreased. When the air conditioner is operated with a very small load, the cooling medium compressor Cp is brought to be minimum in capacity to make the discharging quantity of the cooling medium minimum. At the same time, the heat sensitive fluid is further contracted within the heat sensitive cylinder 23 to push the diaphragm 36 upwardly. As a result, the valve stem 35 which moves together with the diaphragm 36 is further pulled upwardly to bring the valve 34 into a tight engagement with the seat face 32*a* as shown in FIG. 8(*a*).

Since the internal part of the valve housing 32 is communicated by the passage 33 formed on the seat face 32*a* even under the above-described circumstance, a small quantity of cooling medium is fed into the evaporator 1 for evaporation through the passage 33.

In this case, since the feeding quantity of the cooling medium and the flowing resistance or pressure loss within the evaporator 1 are brought to be minimum by the expansion valve 21, the pressure differential between the outlet tube and the oil returning tube 12 reaches the minimum.

As a consequence, the pressure responsive valve 41 is moved to its lowermost position by the spring 43. As a result, the space between the seal face 41*a* and the opening portion 40 as well as the space between the stopper 44 and the step portion 46 are opened to maximum extent as shown in FIG. 10(*a*). As a result, the flowing resistance thereof is decreased to enhance the oil returning through the oil returning tube 12 under low pressure.

Accordingly, the oil returning is smoothly performed through the oil returning tube 12 even under the minimum operation of the air conditioner as mentioned. Thus, an oil returning quantity meeting with such operation state of the cooling medium compressor 1 at this time can be obtained and a sufficient lubrication can be performed.

Next, when, for example, the cooling medium flowing within the outlet tube 3 reaches a predetermined temperature or more and the cooling load of the air conditioner becomes high under such operation of the air conditioner as mentioned, the heat sensitive fluid within the heat sensitive cylinder 23 is expanded by heat to push down the diaphragm 36. As a result, the valve stem 35 integrally formed with the diaphragm 36 is moved downwardly. As a result, the space between the valve 34 and the seat face 32*a* is opened as shown in FIG. 8(*b*). As a result, the feeding quantity of the cooling medium within the evaporator 1 is increased to enhance the cooling performance.

Accordingly, the flowing resistance or pressure loss within the evaporator 1 is increased. On the other hand, since the cooling medium compressor Cp is brought to be maximum in capacity before or after this and the discharging quantity of the cooling medium is increased, the pressure differential between the outlet tube 3 and the oil returning tube 12 is increased.

Because of the foregoing reason, the pressure responsive valve 41 is pushed upwardly by the pressure within the oil returning tube 12 resisting the spring 43. As a result, the opening portion 40 is blocked with the seal face 41*a* as shown in FIG. 10(*b*) to cut the communication between the valve main body 39 and the outlet tube 3.

Accordingly, the lubricating oil 24 guided into the oil returning tube 12 is prevented from flowing out into the outlet tube 3 and stays within the tube 12. On the other hand, a normal cooling medium flow is recovered within the outlet tube 3 and such normal oil returning or lubrication is performed as that the lubricating oil is moved together with the cooling medium gas and returned into the cooling medium compressor Cp.

Since an oil returning mechanism of an evaporator for an air conditioner according to the present invention is such constituted as described in the foregoing, when the cooling load is small, the lubricating oil reserved in the oil reservoir of the evaporator after oil separation can be introduced into the outlet tube to enhance the oil returning to the cooling medium compressor. And, the possible decrease of the lubricating oil in the cooling medium compressor which is readily occurred at this time can be decreased thereby to obtain a favorable lubrication. Particularly, this effect is effective for eliminating the anxiety with respect to the lubrication and oil returning to a compressor in an air conditioner equipped with a variable capacity type cooling medium compressor which is anticipated to be widely prevailed in the near future when it is operated under very small load.

Moreover, according to the present invention, when the cooling load is so large as that the pressure differential between the outlet tube and the oil returning tube reaches a predetermined level or more, the decrease of the cooling performance can be prevented by cutting the flow-out of the lubricating oil through the oil returning tube, and a normal oil returning can be performed.

Furthermore, according to the present invention, a throttle valve formed with orifices is movably disposed within the outlet tube and the throttle valve is moved within the outlet tube when the controlling valve is opened, so as to increase the pressure differential between the oil returning tube and the outlet tube. Accordingly, when the cooling load is so small as that the pressure differential becomes a predetermined level or less, the oil returning to the cooling medium compressor can be efficiently performed.

In addition, according to the present invention, even when the cooling load is a predetermined level or less, the minimum quantity of the cooling medium is fed to the evaporator so that a required quantity of the lubricating oil can be returned to the cooling medium compressor. Accordingly, the possible burning of the variable capacity type cooling medium compressor can be prevented when the compressor is operated under very small load.

What is claimed is:

1. An air conditioner including a cooling medium compressor, a condenser, an expansion valve and an evaporator, these being connected one another by a cooling medium capillary tube to circulate a cooling medium, whereby an oil returning mechanism of an evaporator for the air conditioner is characterized in that there is provided an oil reservoir for reserving a lubricating oil after oil separation at a lower part of said evaporator, said oil reservoir and an outlet tube for guiding the cooling medium passed through said evaporator to said cooling medium compressor being connected by an oil returning tube, said oil returning tube being provided with a controlling valve, when a pressure differential between said oil returning tube and said outlet tube is a predetermined level or more, said controlling valve being closed to enhance a normal flow of the cooling medium from said evaporator to said cooling medium compressor, when said pressure differential is a predetermined level or less, the lubricating oil staying in the oil reservoir being fed to said cooling medium compressor via said oil returning tube and outlet tube.

2. An oil returning mechanism of an evaporator for an air conditioner as claimed in claim 1 characterized in that there are provided a valve main body which is moved according to the pressure differential between said outlet tube and oil returning tube to communicate both of them and a throttle valve which moves in and out said outlet tube together with said valve main body within said controlling valve, when said controlling valve being opened, said throttle valve being moved into said outlet tube to increase the pressure differential between said outlet tube and said oil returning tube through the pressure reducing effect, thereby to increase a feeding quantity of a lubricating oil to said cooling medium compressor.

3. An oil returning mechanism of an evaporator for an air conditioner as claimed in claim 1 characterized in that there is provided a valve which is able to be attached to and detached from a seat face and adapted to regulate a flowing quantity of the cooling medium to said evaporator according to a cooling load within a cooling medium inlet tube of said evaporator, said seat face being formed with a groove-like passasge which is communicated with a cooling medium flowing passage leading to said evaporator, when said valve is closed under the cooling load of a predetermined level or less, the minimum quantity of the cooling medium being fed to said evaporator through said passage.

* * * * *